United States Patent [19]

Takano et al.

[11] Patent Number: 4,796,055

[45] Date of Patent: Jan. 3, 1989

[54] RECORDING APPARATUS INCORPORATING MANUAL PAPER FEEDER

[75] Inventors: Yoshiaki Takano; Masakazu Sogame, both of Toyokawa; Tsuneo Kitagawa, Toyohashi, all of Japan

[73] Assignee: Minolta Camera Kabushiki Kaisha, Osaka, Japan

[21] Appl. No.: 3,243

[22] Filed: Jan. 14, 1987

[30] Foreign Application Priority Data

Jan. 28, 1986 [JP] Japan ..... 61-17217

[51] Int. Cl.[4] ..... G03G 15/00

[52] U.S. Cl. ..... 355/14 SH; 355/3 SH; 271/265

[58] Field of Search ..... 355/3 SH, 14 SH, 14 R; 271/265

[56] References Cited

U.S. PATENT DOCUMENTS 3,649,114 3/1972 Vlach et al. ..... 355/3
3,706,491 12/1972 Furman et al. ..... 355/15 X
3,851,966 12/1974 Reehil et al. ..... 355/14 R X
3,960,446 6/1976 Ogawa et al. ..... 355/13
4,349,269 9/1982 Okada ..... 355/14 SH
4,392,740 7/1983 Ito et al. ..... 355/14 SH
4,451,136 5/1984 Tanioka et al. ..... 355/14 SH

FOREIGN PATENT DOCUMENTS 57-141652 9/1982 Japan ..... 355/5

*Primary Examiner*—A. C. Prescott
*Assistant Examiner*—Janie Lau
*Attorney, Agent, or Firm*—Burns, Doane, Swecker & Mathis

[57] ABSTRACT

An recording apparatus of the present invention has a manual paper feed mechanism which includes a paper inlet, a timing roller and a paper outlet. When a paper is inserted into the paper inlet at a proper timing, the paper is recorded images thereon and then discharged out of the paper outlet. When the paper is inserted at an improper timing, for example, during the rotation of the timing roller, however, the paper is discharged out of the paper outlet without image recording thereon.

13 Claims, 7 Drawing Sheets

RECORDING APPARATUS INCORPORATING MANUAL PAPER FEEDER

BACKGROUND OF THE INVENTION

The present invention relates to a recording apparatus for forming images on record paper, and more particularly to a recording apparatus adapted for use with sheets of paper which are fed one by one manually.

Recording apparatus for copying images of originals on record paper are already proposed in U.S. Pat. Nos. 4,392,740, 4,349,269, etc. These recording apparatus have an automatic paper feeder for automatically feeding record paper of specifed size to the image forming unit of the apparatus and also a manual paper feeder for manually feeding record paper to the image forming unit so that paper of a desired size different from the specified size is usable for recording.

The manual paper feeder and the automatic paper feeder are generally adapted to be driven for a period of time longer than is theoretically needed for transporting record paper in order to correct the possible error to be involved in the transport of the record paper, for example, due to the slippage of the paper relative to the roller. Accordingly, when the paper is fed normally, the feeder continues its operation for a short period of time after the completion of feeding.

When record paper is to be fed manually to the apparatus following an automatic feeding operation, there is a likelihood that the user will feed the paper before the preceding sheet is not completely fed automatically. The apparatus is then likely to start a copying operation for the manually fed paper although it is not in condition for forming the next copy image. In this case, it becomes impossible to position the leading end of the image in timed relation with the forward end of the record paper which is fed with improper timing, consequently producing a faulty copy. Such a problem also arises when a plurality of record sheets are fed to the apparatus manually in succession.

SUMMARY OF THE INVENTION

The main object of the present invention is to provide an improved recording apparatus having a manual paper feeder.

Another object of the invention is to provide a recording apparatus which is free of the likelihood of producing a faulty copy with record paper manually fed with improper timing.

To achieve these objects, the present invention provides a recording apparatus which is so adapted that record paper placed in with improper timing is discharged as it is from the apparatus with no image formed thereon.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE PREFERRED EMBODIMENTS

An embodiment of the present invention will be described below.

Figure 1:
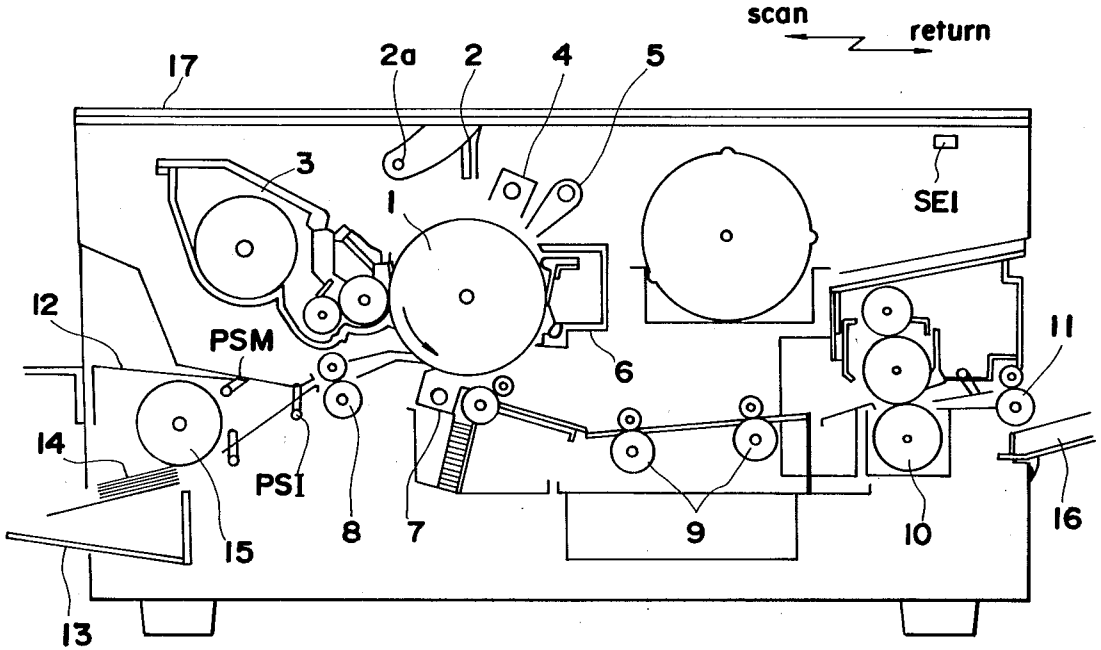
FIG. 1 is a sectional view schematically showing the construction of a recording apparatus embodying the invention.

FIG. 1 is a front view in vertical section and schematically showing a copying machine embodying the present invention. The copying machine includes a photoconductive drum 1, an optical system 2 for forming an image of the original to be copied on the drum 1, a developing unit 3, a sensitizing charger 4, an eraser lamp 5, a cleaner 6, a transfer unit 7, a timing roller 8, transport rollers 9, a fixing unit 10, a discharge roller 11, a manual feed opening 12, a paper cassette 13, copy paper 14 within the cassette 13, a feed roller 15, a paper tray 16 and a document table 17. Indicated at PSM and PSI are first and second paper sensors, respectively, for detecting the copy paper manually inserted through the feed opening 12.

Next, the operation of the copying machine will be described.

According to the present embodiment, the document table 17 is reciprocatingly movable horizontally. When the document table 17 moves leftward in the drawing, the original on the table is scanned by the optical system 2. The optical system 2, which comprises an array of bundled lens elements, projects an image of the original on the photoconductive drum 1 to form an electrostatic latent image on the drum 1. The drum 1 rotates in the direction of the arrow shown, permitting the developing unit 3 to develop the latent image on the drum 1.

The developed image of the original is transferred by the transfer unit 7 onto the copy paper sent forward thereto. The copy paper bearing the transferred image is fed by the transport rollers 9 to the fixing unit 10, in which the image is fixed to the pper by a fixing roller. The paper is then delivered onto the tray 16 by the discharge roller 11.

The toner remaining on the drum 1 after the image transfer is removed by the cleaner 6. The residual charges are then removed from the drum by the eraser lamp 5. The drum 1 is thus made ready for the next copying cycle starting with sensitization by the charger 4.

In the case of automatic paper feeding, a sheet of copy paper 14 is withdrawn from the cassette 13 by the feed roller 15, sent into a path of transport and brought into contact with the timing roller 8 paired with another roller, whereupon the sheet is temporarily held in a standby position. The timing roller 8 is still held out of rotation.

On the other hand, a sensor SE1 for detecting the position of the document table is disposed in the path of travel of the document table 17. When the table 17 comes to a specified position, the sensor SE1 is turned on, giving a signal which initiates the timing roller 8 into rotation to forward the copy paper. This brings the leading end of the paper into register with the front end of the original image on the drum 1 for the transfer of the image to a predetermined position on the paper.

When to be fed manually, copy paper is inserted through the feed opening 12 to a position immediately before the timing roller 8. Arranged in the path of transport of the copy paper manually fed are the abovementioned first paper sensor PSM and second paper sensor PSI, the latter being positioned in proximity to the timing roller 8. The copy paper inserted is detected by these sensors PSM and PSI, whereupon copying operation is started for the manually fed paper. As is the case with automatic paper feeding, the timing roller 8 is driven upon the table 17 passing the specified position.

On the other hand, the timing roller 8 is brought out of rotation a predetermined period of time T after the rear end of the copy paper has passed the paper sensor PSI both in the manual feed mode and in the automatic feed mode. The time period T, which is required for the copy paper to pass over the timing roller 8 after moving past the paper sensor PSI, is made slightly longer than is theoretically required in view of variations in the amount of feed of the paper due to the variation in the speed of rotation of the drive motor, slippage of the paper relative to transport rollers, etc. Accordingly, when the copy paper is transported normally, the timing roller 8 remains in rotation for a short period of time after the rear end of the paper has passed over the timing roller 8.

While the timing roller 8 is ttill in rotation before the completion of the preceding copying cycle, the next sheet of copy paper, if inserted through the manual feed opening 12 with its leading end reaching the timing roller 8, will be sent to the transfer station before a timing signal is produced by the travel of the document table 77. If the copy paper is manually fed with timing other than the propr timing for image formation in this way, the control means of the present invention to be described below acts to discontinue image formation for the paper, allowing the paper to be delivered as it is onto the paper tray 16. In the event of improper timing, the formation of image is discontinued by operating the elements associated with transport, such as timing roller 8, the transport rollers 9 and the fixing unit 10 while holding out of operation the elements associated with image formation and including the exposure lamp 2*a*, sensitizing charger 4, transfer unit 7 and document table 17.

Thus, the copy paper manually fed with improper timing is discharged as it is from the machine without bearing any faulty image thereon. The discharged paper is usable again.

Figure 2:
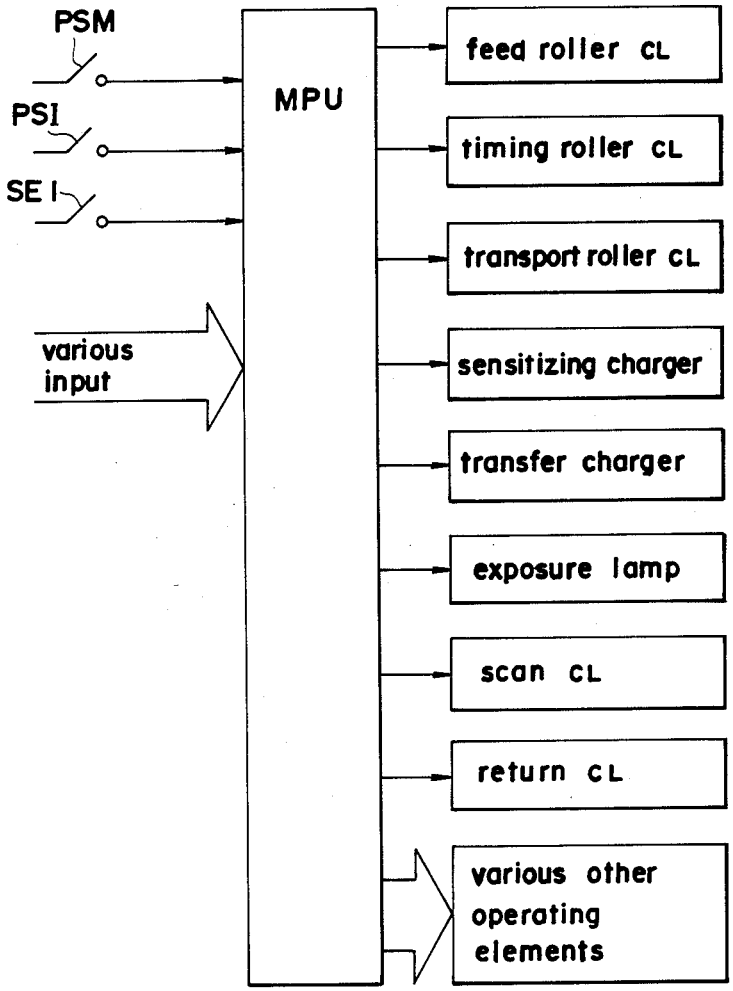
FIG. 2 is a block diagram schematically showing a control circuit.

FIG. 2 is a block diagram schematically showing the circuit for controlling the operation of the copying machine.

The control circuit consists essentially of a microcomputer MPU having connected to its input ports the paper sensors PSM, PSI, the document table position detecting sensor SE1, various input switches and sensors, etc. Connected to the output ports of the microcomputer MPU are a feed roller clutch, a timing roller clutch, transport roller clutches, the sensitizing charger, the transfer charger, the exposure lamp, a scan clutch, a return clutch and various other operating elements.

Figure 3:
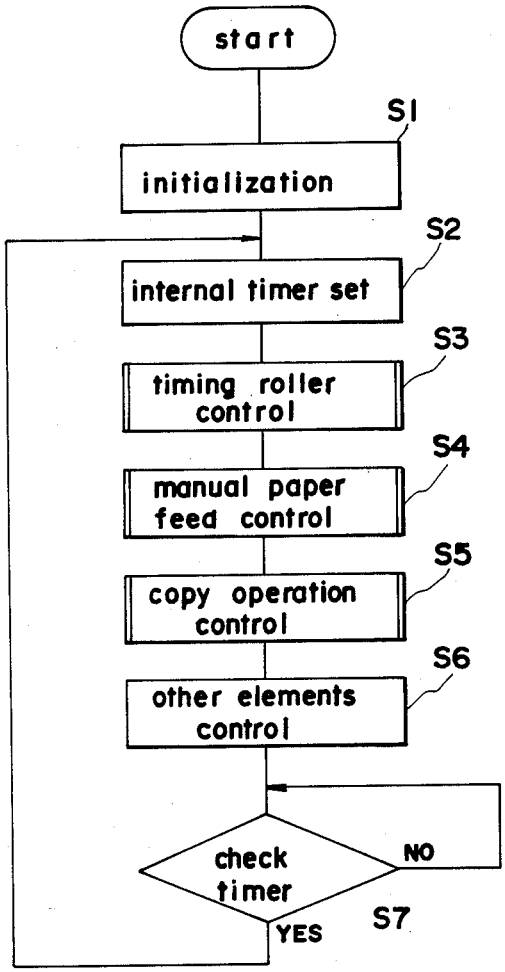
FIG. 3 is a flow chart generally showing a control process employing a microcomputer.

The microcomputer MPU controls the machine through the process generally shown in the flow chart of FIG. 3.

When the power supply for the copying machine is turned on, the microcomputer MPU is initiated into control operation. The microcomputer MPU is initialized in step S1.

In step S2, an internal timer is set for use in the control routine.

Figure 4:
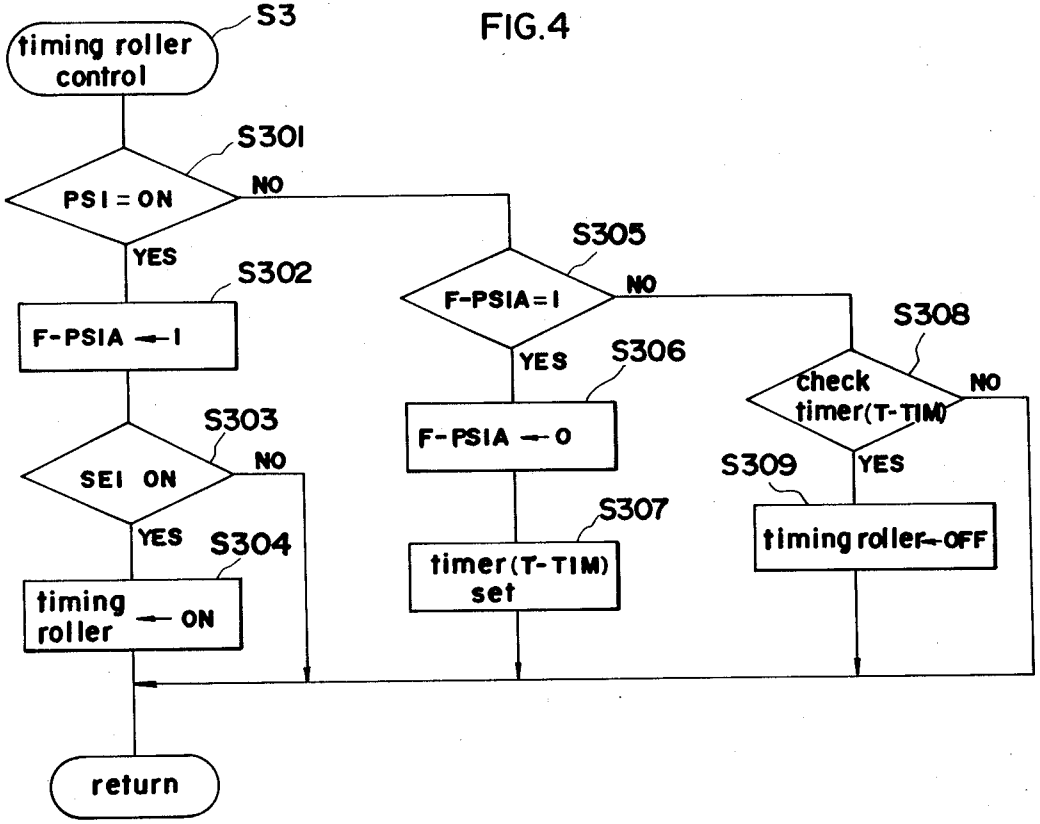
FIG. 4 is a flow chart showing a timing roller control subroutine in detail.

Step S3 is a subroutine for the drive control of the timing roller 8 as will be described later in detail with reference to FIG. 4.

Step S4 is a manual paper feed control subroutine including a control procedure for the paper manually inserted with improper timing as mentioned above. The control subroutine will be described in detail with reference to FIG. 5.

Step S5 is a copying operation control subroutine for forming a copy image on copy paper as will be described later in detail with reference to FIG. 6.

Step S6 is a procedure for operating operation elements in response to various inputs related to the control of copying operation. This procedure will not be described in detail.

Step S7 checks the count on the internal timer set in step S2. When a predetermined count value has been counted up by the timer, the sequence returns to step S2. The processing time for every routine is made constant by this step irrespective of the progress of the subroutines.

With reference to the flow chart of FIG. 4, the timing roller control subroutine will be described in detail.

Step S301 checks the state of the paper sensor PSI. The sensor PSI functions when the leading end of the copy paper manually inserted through the manual feed opening 12 or automatically dispensed from the paper cassette 13 has reached the sensor PSI.

Upon the sensor PSI detecting the leading end of the copy paper, a resist first flag PSIA is set to "1" in step S302. This flag indicates that the copy paper has reached the paper sensor PSI. Although a detailed description will not be given, the document table 17 starts scanning with the same timing as the actuation of the sensor PSI.

Step S303 checks the state of the document table position detecting sensor SE1. When reaching the specified position, the scanning table 17 turns on the sensor SE1, whereupon the timing roller 8 is brought into rotation in step S304 to feed the copy paper to the transfer unit.

When the rear end of the copy paper brought into travel toward the transfer unit has passed the paper sensor PSI, the sensor PSI is turned off. The sequence now proceeds from step S301 to step S305.

Step S305 checks whether the resist first flag PSIA is "1". The flag PSIA, if "1", is reset to "0" in step S306. Step S307 sets a timer TIM for stopping the timing roller 8 upon lapse of the aforementioned predetermined period of time T. Steps S306 and S307 are performed only once when the resist first flag PSIA is "1", i.e. upon the rear end of the copy paper passing the paper sensor PSI.

Step S308 interrogates whether the time set on the timer TIM in step S307 is up. If the time is up, the timing roller 8 is stopped in step S309. Thus, the timing roller is brought out of rotation the predetermined period of time after the detection of the paper rear end by the sensor PSI.

Figure 5:
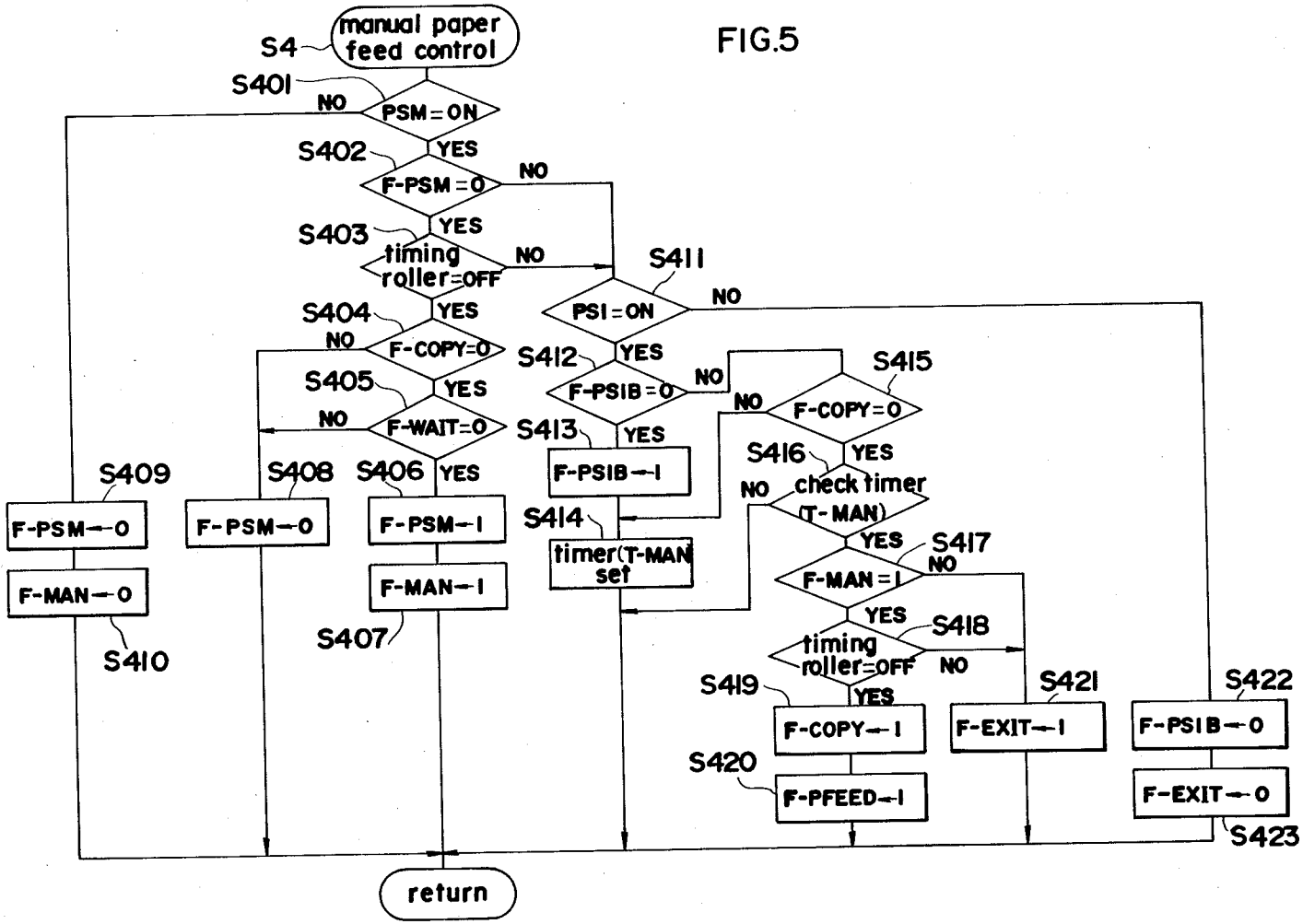
FIG. 5 is a flow chart showing a manual paper feed control subroutine in detail.

Next with reference to FIG. 5, the manual paper feed control subroutine will be described in detail. Executed in this subroutine is special control for the copy paper manually inserted with improper timing as already stated.

Step S401 checks the state of the paper sensor PSM. This sensor PSM is actuated upon detecting the leading end of copy paper inserted through the manual feed opening 12.

Step S402 checks the state of a manual insertion flag FPSM which indicates the presence of copy paper manually inserted and detected by the paper sensor PSM. The flag FPSM, which is to be set to "1" in the step S406 to be described below, is "0" when the leading end of the manually inserted paper is detected by the sensor PSM. When the copy paper is manually inserted, therefore, steps S403 et seq. are first executed.

Step S403 checks whether the timing roller 8 is in rotation. If the timing roller 8 is out of rotation, the sequence proceeds to steps S404 et seq. to start copying operation for the manually inserted paper. If otherwise, steps S411 et seq. follow. Thus, when a sheet of copy paper is manually inserted before the rotation of the timing roller 8 for the preceding sheet is discontinued, the procedure (steps S404 to S408) for starting copying operation for the normally inserted paper is not executed, but special control is effected for the paper manually inserted with improper timing.

Step S404 checks whether a copy flag COPY for indicating copying operation being conducted is "0" which shows that the machine is not in copying operation. Step S405 checks whether a waiting flag WAIT for indicating the fixing unit being heated is "0" which shows that the machine is ready to start copying operation.

When the answers to the inquiries of steps S404 and S405 are both affirmative, the manual insertion flag FPSM is set to "1" in step S406, and a manual insertion mode flag FMAN for indicating that the machine is in the manual paper feed mode is set to "1" in step S407.

On the other hand, if the answer to at least one of the inquiries of steps S404 and S405 is negative, i.e. when the next copying operation can not be initiated, the manual insertion flag FPSM is reset to "0" in step S408.

Further when the paper sensor PSM is found off in step S401, the flag FPSM is reset to "0" in step S409, and the manual issertion mode flag FMAN is reset to "0" in step S410 to bring the machine out of the manual paper feed mode.

Step S411 checks the state of the paper sensor PSI, which is on while detecting the manually inserted paper or is otherwise off. Accordingly, while the sensor PSI is detecting the copy paper, steps S412 et seq. follow, whereas if otherwise, a resist second flag PSIB and an abnormal discharge flag EXIT are set to "0" in steps S422 and S423, respectively.

When the paper sensor PSI is on, step S412 checks the state of the resist second flag PSIB. The moment when the sensor PSI is actuated, detecting the manually inserted copy paper, the flag PSIB is still "0" and is therefore set to "1" in step S413, which is followed by step S414 to set a manual insertion delay timer TMAN. The timer TMAN is adapted to set a period of time corresponding to the time taken for the leading end of the manually inserted paper to travel from the sensor PSI to the timing roller 8.

With the resist second flag PSIB set to "1" after the paper sehsor PSI has detected the leading end of the paper, steps S415 et seq. follow step S412.

Step S415 checks the state of the copy flag COPY. Unless the copy flag COPY is set to "1", i.e. unless the machine is in copying operation, the sequence proceeds to step S416, whereas if otherwise, step S414 follows.

The timer TMAN set in step S414 is checked in step S416 for the lapse of set time.

When the time is found to be up, step S417 checks the state of the manual insertion mode flag FMAN, and step S418 checks whether the timing roller 8 is in rotation. If the flag FMAN is not "0" and further if the timing roller 8 is not in rotation, step S419 sets the copy flag COPY to "1", and step S420 sets a copying start flag PFEED to "1". Setting the flag PFEED starts a normal copying operation.

On the other hand, if the manual insertion flag FMAN is found "0" in step S417, i.e. if step S403 finds the timing roller to be on, leading to the current step, or if the timing roller 8 is found to be in rotation in step S418, this means that the paper is manually inserted with improper timing. In this case, the abnormal discharge flag EXIT is set to "1" in step S421, whereupon the paper is discharged from the machine according to the copying operation control subroutine to be described below with no copying operation conducted for the paper.

Figure 6:
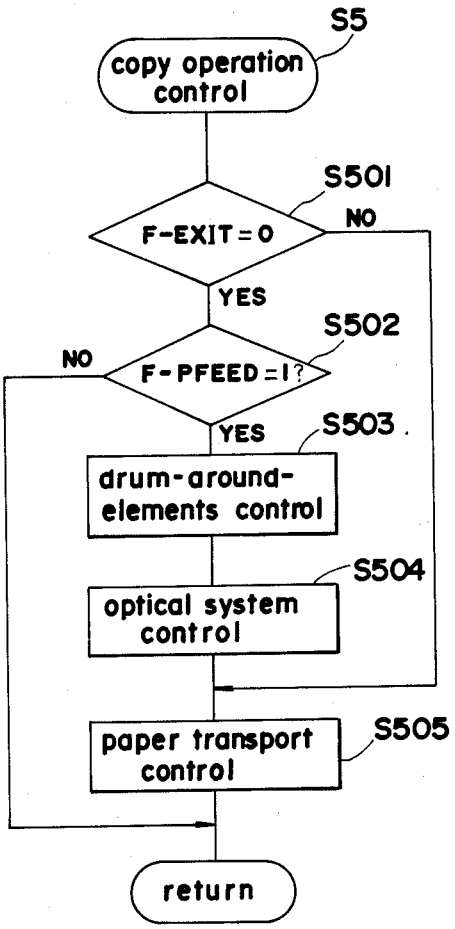
FIG. 6 is a flow chart generally showing a copying operation control subroutine.

FIG. 6 is a flow chart generally showing the copying operation control subroutine.

Step S501 checks the state of the abnormal discharge flag EXIT. When the copy paper is manually inserted with proper timing, the flag EXIT is "0", and step S502 follows. If the paper is manually inserted with improper timing, the flag EXIT is already set to "1" in step S421, so that step S505 follows.

The state of the copying start flag PFEED is checked in step S502. When the paper is manually inserted with proper timing, the flag PFEED is already set to "1" in step S420, and the sequence therefore proceeds to step S503 et. seq.

Step S503 is a subroutine for controlling the elements around the photoconductive drum, such as the developing unit 3, sensitizing charger 4, eraser lamp 5, cleaner 6 and transfer unit 7. The subroutine will not be described in detail.

Step S504 is a subroutine for controlling the optical system, more specifically for controlling the operation of clutches for moving the lamp 2*a* and the document table 17 for scanning and return. A detailed description will be omitted.

Step S505 is a subroutine for controlling transport of the copy paper through the path extending from the timing roller 8 to the discharge roller 11. More specifically, the copy paper reaching the timing roller 8 is passed through the transfer station, the fixing unit 10, etc. and deliveted onto the paper tray 16 by this step. This control procedure will not be described in detail.

Thus, the subroutines of steps S503, S504 and S505 are executed to form a proper copy image on the paper manually inserted with proper timing.

On the other hand, the copy paper manually inserted with improper timing is merely transported without image formation, executing the subroutine of step S505 only with neither of the subroutines of steps S503 and S504 performed. Consequently, the paper improperly inserted is delivered as it is onto the paper tray 16.

According to the embodiment described above, steps S503 and S504 for operating the elements around the drum and for driving the optical system are not performed for the copy paper manually inserted with improper timing to preclude formation of a faulty copy, but all of these elements need not be held out of operation; the objects of the present invention can be accomplished insofar as at least the transfer unit 7 is held out of operation.

Figure 7:
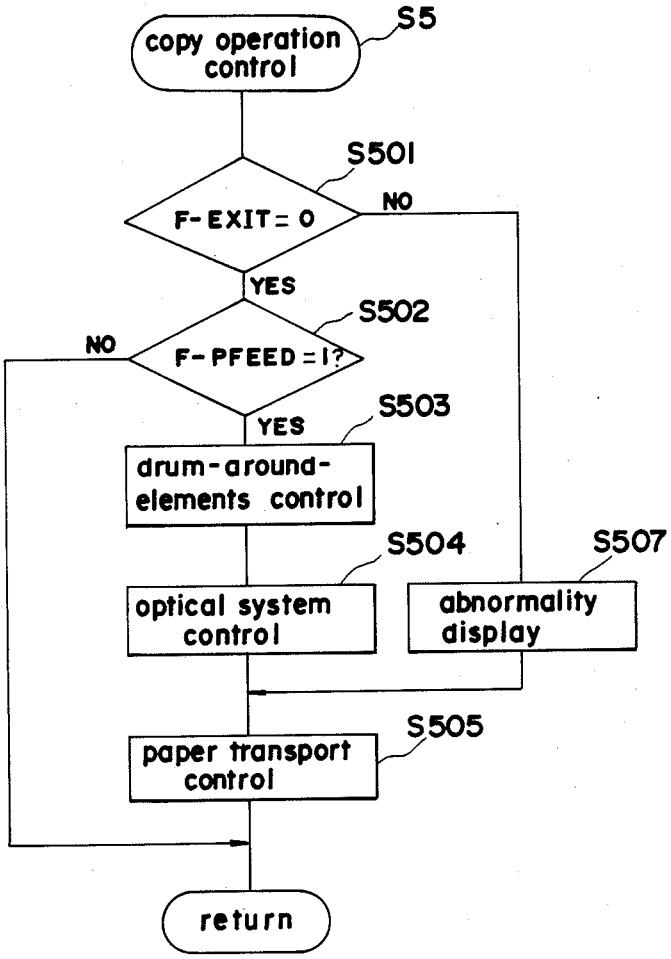
FIG. 7 is a flow chart showing another example of copying operation control subroutine.

FIG. 7 shows a modification of the copying operation control subroutine shown in FIG. 6. With this modification, when the abnormal discharge flag EXIT is found to be "1" in step S501, i.e. when a sheet of copy paper is manually inserted with improper timing, step S507 displays the abnormality, notifying the operator that normal image recording is not conducted for the paper currently inserted manually. Step S505 thereafter follows to transport the paper. The abnormality may be displayed, for example, by turning on an alarm lamp, showing a specific trouble code, flickering a lamp which is normally on, giving off a voice or buzzing.

What is claimed is:

1. An image recording apparatus comprising:
means for transporting a paper inserted into a paper inlet toward a paper outlet through a recording position;
means for recording image onto the paper transported by said transporting means at the recording position; and
means for executing the paper transport operation by said transporting means without the image record operation by said recording means when paper is inserted into the paper inlet at an improper timing.

2. An image recording apparatus as claimed in claim 1, further comprising means for detecting the paper inserted into the paper inlet.

3. An image recording apparatus as claimed in claim 2, wherein said transporting means and image recording means initiate their operation in response to the detecting means.

4. An image recording apparatus as claimed in claim 3, wherein said transporting means and image recording means are synchronized with each other so as to record images onto a prescribed position of inserted paper.

5. An image recording apparatus as claimed in claim 4, wherein said executing means executes the transport operation without the image recording operation when paper is inserted into the paper inlet during the operation of said transporting means.

6. An image recording apparatus comprising:
means for transporting a paper inserted into a paper inlet toward a paper outlet through a recording position;
means for recording image onto the paper transported by said transporting means at the recording position;
means for adjusting the operation timings of said recording means and transporting means so as to record images onto a prescribed position of paper; and
means for executing the paper transport operation by said transporting means without the image record operation by said recording means when paper is inserted into the paper inlet at an improper timing in which said adjusting means is impossible to adjust the operation timings.

7. An image recording apparatus as claimed in claim 6, wherein said transporting means includes a timing roller.

8. An image recording apparatus as claimed in claim 7, wherein said timing roller is controlled by said adjusting means.

9. An image recording apparatus as claimed in claim 8, wherein said adjusting means is possible to adjust the operation timing when a paper is inserted into the inlet while the timing roller is stopped.

10. An image recording apparatus comprising:
means for recording image onto a paper at a recording position;
a timing roller for feeding the paper inserted into a paper inlet toward the recording position, the feed operation of said timing roller synchronized with the recording operation of said recording means;
means for detecting the paper inserted into the paper inlet; and
means for discharging the inserted paper out of the apparatus through the recording position without executing the image recording operation by said recording means when the paper is inserted during the paper feed operation is executed by said timing roller.

11. An image recording apparatus comprising:
means for transporting a paper inserted into a paper inlet toward a paper outlet through a recording position;
means for recoridng images onto the paper transported by said transport means at the recording position;
means for inhibiting the image recording operation and for informing an improper status when paper is inserted into the paper inlet at an improper timing; and
means for controlling the transporting means so as to continue the transport operation in the improper status.

12. An image recording apparatus as claimed in claim 11, wherein the paper inserted into the paper inlet at the improper timing is discharged from the paper outlet without image recording thereon.

13. An image recording apparatus comprising:
means for transporting a paper manually inserted into a paper inlet toward a paper outlet through a recording position;
means for recording image onto the paper transported by said transporting means at the recording position; and
means for executing the paper transport operation by said transporting means without the image record operation by said recording means when paper is manually inserted into the paper inlet at an improper timing.

* * * * *